US005078075A

United States Patent [19]

Liming et al.

[11] Patent Number: 5,078,075

[45] Date of Patent: Jan. 7, 1992

[54] ANTENNA CLAMP

[76] Inventors: Richard E. Liming; Treesa V. B. Liming, both of 916 Woodlawn Ave., Springfield, Ohio 45504

[21] Appl. No.: 722,087

[22] Filed: Jun. 27, 1991

[51] Int. Cl.[5] ..... G09F 17/00

[52] U.S. Cl. ..... 116/173; 116/28 R; 403/165; 403/289

[58] Field of Search ..... 116/173, 174, 175, 28 R, 116/209, 264, 265; 343/894, 715, 900, 901; 403/165, 135, 361, 289, 290; 40/591, 592; 248/219.2, 229, 231.6

[56] References Cited

U.S. PATENT DOCUMENTS

| | | | |
|---|---|---|---|
| 2,329,046 | 9/1943 | Halbig | 116/173 |
| 2,856,891 | 10/1958 | Solomon | 116/173 |
| 3,075,492 | 1/1963 | Winfrey | 116/173 |
| 3,114,129 | 12/1963 | Gilbert | 116/173 |
| 3,153,294 | 10/1964 | Hay et al. | 403/289 X |
| 3,172,220 | 3/1965 | Christensen | 40/39 |
| 3,526,050 | 9/1970 | Weller | 40/129 |
| 3,636,912 | 1/1972 | Kamp | 116/173 X |
| 4,388,012 | 6/1983 | Erickson | 403/165 X |
| 4,526,820 | 7/1985 | Haas | 428/31 |
| 4,624,211 | 11/1986 | Jokel | 116/209 |
| 4,875,431 | 10/1989 | Dobosz | 116/173 |
| 4,901,662 | 2/1990 | Sandeen et al. | 116/28 R |
| 4,964,360 | 10/1990 | Henry | 116/28 R |
| 4,978,964 | 12/1990 | Castille | 343/715 |
| 4,989,536 | 2/1991 | Liming et al. | 116/173 |
| 5,042,418 | 8/1991 | Hoover et al. | 116/28 R X |

*Primary Examiner*—William A. Cuchlinski, Jr.
*Assistant Examiner*—John L. Beres

[57] ABSTRACT

The antenna clamp holds securely a connective member of an object suitable for display at the top of a vehicle antenna mast. The clamp consists of a hinged inner part called the enclosing unit, which is configured to fit around both mast and the tip at the top of the mast and secure the connective member to the mast, and an engaging device, of which there are several, to hold mechanically the enclosing unit on the mast and tip. The antenna clamp is rotatable, easily attached and removed, and does not affect radio reception.

18 Claims, 3 Drawing Sheets

ANTENNA CLAMP

BACKGROUND

1. Field of Invention

This invention relates to a clamp that will hold securely and rotatably a connective member of an object suitable for display around the top of a vehicle antenna.

2. Description of Prior Art

In our search we were unable to find a device for holding the cord of an appropriately-sized windsock or banner at the top of our vehicle antenna for ease of identification in a parking area, for making a statement, and for adding beauty to our vehicle whether stationary or in motion.

Motorists are presently resorting to tape for tying on a flyer. A ball which is sometimes used offers no variation of display.

Patents we have cited are listed in the Information Disclosure Statement. Only our patent No. 4,989,536 (1991) teaches the securing of a cord of a banner-like object around the top of a vehicle antenna mast. And our patent further teaches that this is accomplished by a holding of an outer part over an inner part by means of a vacuum.

By the submission of this application we seek to patent an invention wherein differently structured parts from those in patent No. 4,989,536 are held in place around the top of a vehicle antenna mast and tip by mechanical means in our preferred as well as other included embodiments. In one of the latter embodiments frictional means is also utilized, but in no embodiment is a vacuum means used to hold a cap over an enclosing unit or keep the enclosing unit itself closed about mast and tip.

OBJECTS AND ADVANTAGES

The antenna clamp holds the cord of a banner-like object simply and securely around the antenna so that the object will not come off or slide down.

It is light in weight, small in size and offers minimum drag with an appropriately sized object attached.

It is neat in appearance, convenient to handle, inexpensive to manufacture and has no affect on radio reception.

It is of a durable plastic-like material UV stabilized and suitable to withstand weather extremes.

It is easily attached to or detached from an antenna mast. Therefore the displayed object can be readily changed or removed for cleaning.

It shows wind direction with banner attached when vehicle is stationary.

It holds means for unique identification in a parking area.

It offers an opportunity for making a statement of choice by way of design, color, logo or emblem for holidays, special events, companies, schools, teams, nationalities and political figures. The list is endless.

It offers individual motorists the opportunity to make their own hand-crafted objects for display.

It offers designers new commercial opportunities to create an endless variety of shapes and colors for display.

In all it permits an object to ride-the-wind giving beauty and life through color in motion whether the vehicle is stationary or moving.

Figure 1:
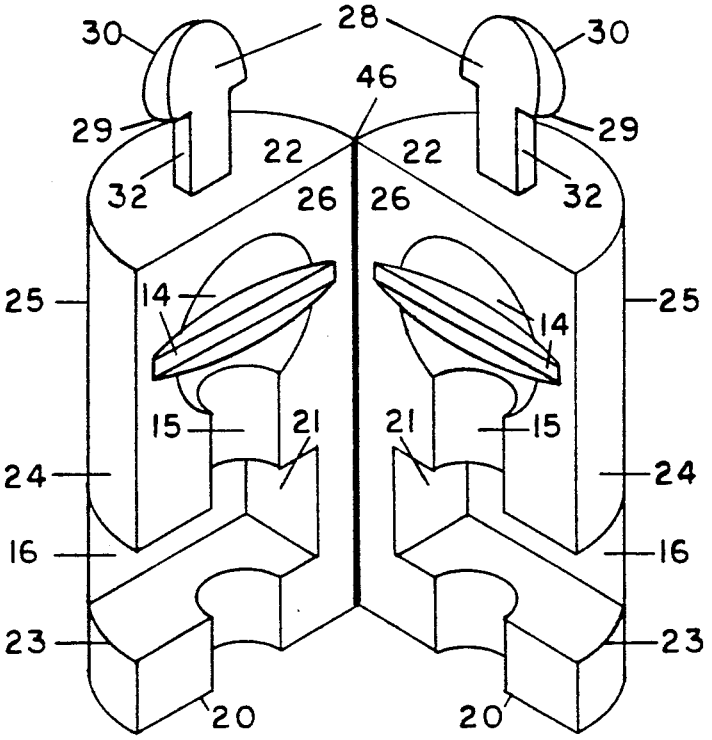
FIG. 1 shows abutment surfaces and pawls of hinged complementary side members.

| Reference Numerals in Drawings |
|---|
| 10. connective member |
| 11. antenna mast |
| 12. tip |
| 13. |
| 14. first ½ cavity |
| 15. second ½ cavity |
| 16. third ½ cavity |
| 17. first cavity |
| 18. second cavity |
| 19. third cavity |
| 20. bottom surface |
| 21. closed end |
| 22. top surface-enclosing unit |
| 23. opening-enclosing unit |
| 24. side surface-enclosing unit |
| 25. complementary side member |
| 26. abutment surface |
| 27. parting line |
| 28. pawl |
| 29. engaging surface |
| 30. slanted surface |
| 31. indent |
| 32. arm |
| 33. male projection |
| 34. female cavity |
| 35. bottom edge-cap |
| 36. aperture-outside cap |
| 37. aperture-inside cap |
| 38. opening-cap |
| 39. side surface-cap |
| 40. bubble |
| 41. top surface-cap |
| 42. opening-spring |
| 43. side surface-spring |
| 44. bottom edge-spring |
| 45. split ring end-spring |
| 46. hinge |
| 47. cap top |

STRUCTURE OF PREFERRED AND ALTERNATIVE EMBODIMENTS IN FIGS. 1 TO 7

Figure 3:
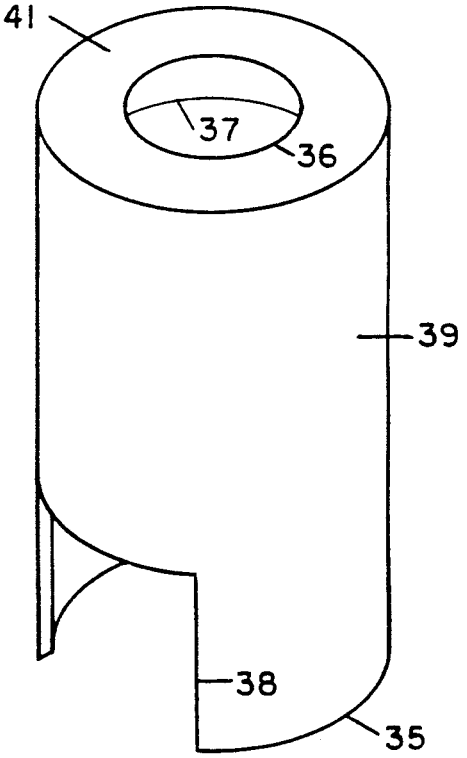
FIG. 3 shows cylindrical cap with opening and aperture.
Figure 4:
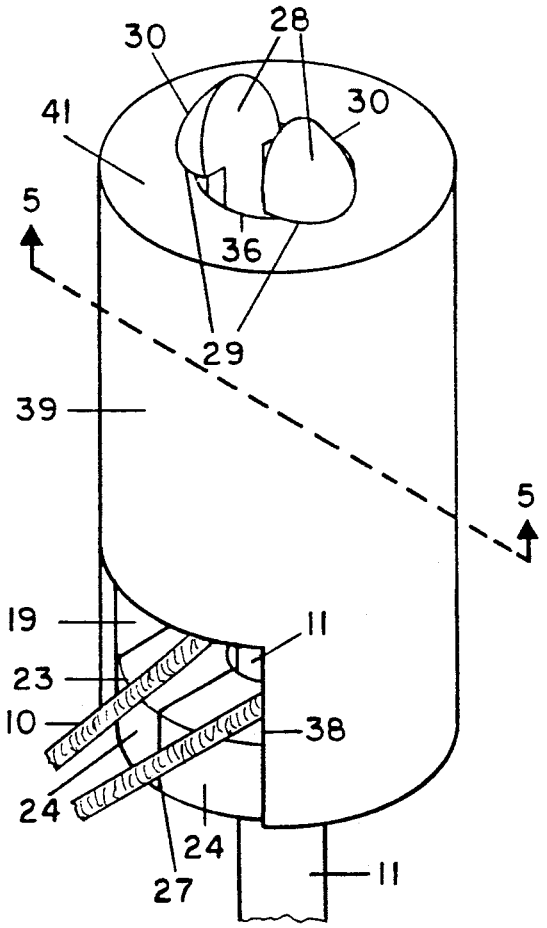
FIG. 4 shows cylindrical cap held on the enclosing unit by pawls with connective member exiting.
Figure 5:
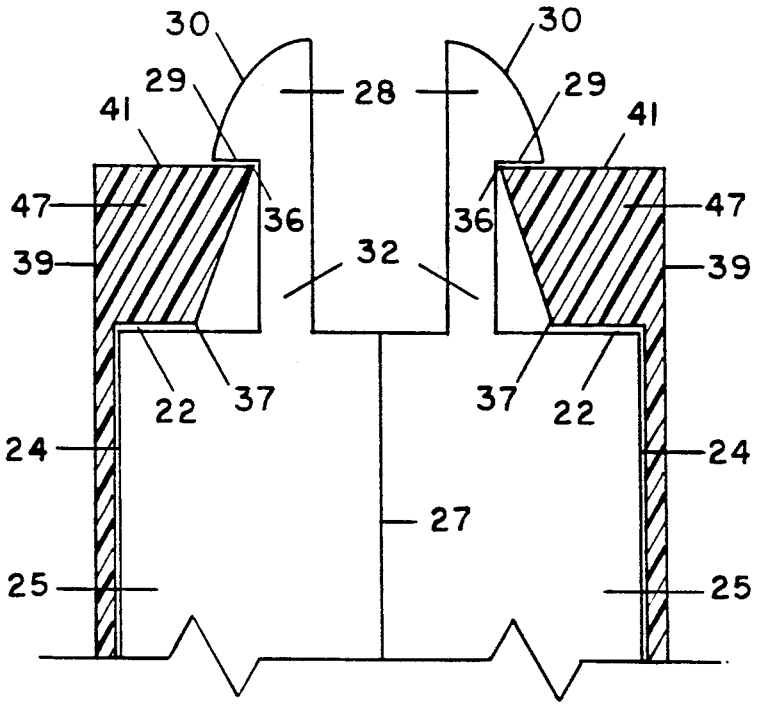
FIG. 5 shows a cross-sectional side view of a top segment of cylindrical cap held in place by pawls over enclosing unit.

The preferred embodiment of our invention of an antenna clamp is illustrated by isometric views in FIGS. 1, 2, 3 and 4 and by a cross sectional front view in FIG. 5. Other significant embodiments are shown by isometric views in FIGS. 6 and 7.

In discussing all embodiments of our application the joint inventors teach of an antenna clamp approximately 1 inch by ½ inch in which different engaging members in various embodiments working in conjunction with an enclosing unit hold mechanically an enclosing unit to a vehicle antenna mast and enlarged tip at its upper end for the purpose of securing around the mast a connective member attached to an object suitable for display.

Though other shapes for the antenna clamp are possible, all embodiments discussed herein are of a cylindrical shape so chosen to minimize wind resistance. The clamp can be molded from a UV stabilized plastic-like material. In the molding process color can be added.

A vehicle antenna mast is made from a metal rod 75 to 80 cm in length and approximately 2.5 to 2.9 mm in diameter and is generally a stationary part of a vehicle's antenna system. Some masts telescope but their relative numbers are small and not addressed in this application. It is our clamp around the top of a stationary antenna mast and tip that holds or keeps a connective member secure. Both clamp and connective member are free to rotate.

The connective member herein noted can be any cord-like member made of a pliable or non-pliable material suitable for holding an object suitable for display. Such objects are windsocks, banners, pennants, and other shapes that can be flown from a vehicle antenna.

A unique feature of the antenna clamp is the following: because a connective member is secured around a mast, the pulling effect is against mast, not against clamp. This reduces wear on both clamp and connective member because the former is not buffeted directly by pull of an object flown from its own structure, and the latter because a connective member pulls from around a smooth steel mast not from around a rough, molded surface. The clamp only figuratively holds a connective member; the reality is that the clamp keeps connective member in place or secures it around a mast within the clamp itself.

Turning to FIG. 1 we see a pair of complementary side members 25 from a possible plurality of such members that might have been employed to produce an enclosing unit. Using a pair of side members is our preferred method of producing an enclosing unit.

Figure 2:
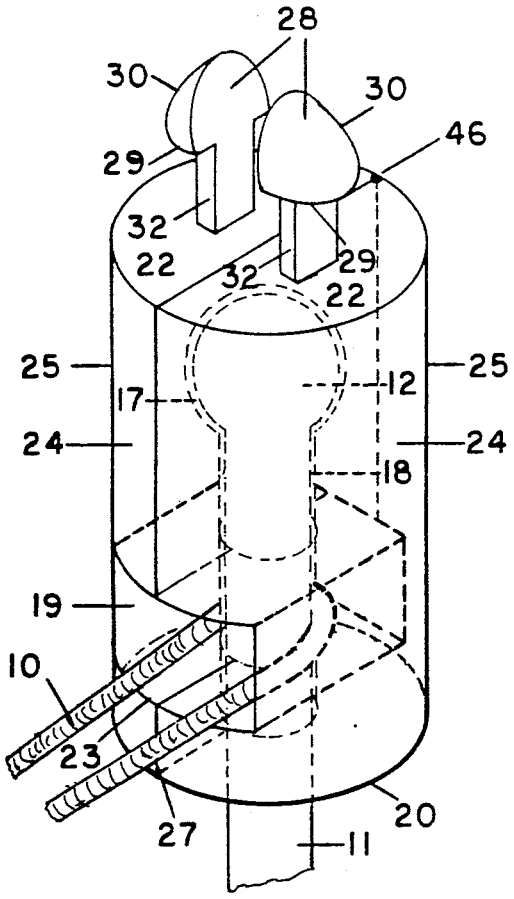
FIG. 2 shows complementary side members and pawls closed around antenna mast and tip with connective member exiting.

Each of the pair of complementary side members of enclosing unit in FIG. 1 has a top surface 22, a bottom surface 20, and an opening 23 in a side surface 24. Perpendicular to top surface 22 and bottom surface 20 is an abutment surface 26. Complementary side members 25 are joined together by a hinge 46 and fit rotatably around a mast 11 and a tip 12 as shown in FIG. 2. Hinging complementary side members 25 facilitates working with the clamp at the top of a mast.

In FIG. 1 each abutment surface 26 of complementary side member 25 has a first ½ cavity 14 showing a spherical shape and a discus shape on a longitudinal center line closer to top surface 22 than other two cavities. This dual shape illustrates the possibility of first ½ cavity being molded to accommodate more than one tip shape.

Surveys undertaken by the joint inventors indicate that an antenna tip can be one of several shapes. Common among them are: spherical, conical and discus. In each case the diameter of the tip is larger than the diameter of the mast to which it is attached. In this Specification section and in the claims section the word tip, rather than enlarged tip, is used frequently.

This first ½ cavity is called tip shape to suggest that any of a variety of these or other shapes can be molded singly or in multiples. While variation can occur in this first ½ cavity, it will occur only in this cavity and not in the other two cavities on abutment surface 26.

Connecting to a bottom part of first ½ cavity 14 on abutment surface 26 is a second ½ cavity 15, a cylindrical cavity, extending longitudinally on a center line from first ½ cavity to the center of bottom surface 20; it is this cavity into which antenna mast 11 fits.

Perpendicular to and laterally traversing second ½ cavity 15 is a third ½ cavity 16 which begins at a closed end 21 and extends past second ½ cavity 15 on to opening 23 on side surface 24. It is in this cavity that connective member 10 fits around mast 11 and exits holding an object suitable for display. The function of this cavity is indicated most clearly in FIG. 2.

Each of the cavity shapes molded in first ½ cavity 14 and cylindrical shape of second ½ cavity 15 are molded slightly larger than structures fitting therein which permits the clamp to be free to rotate around antenna mast 11 and tip 12.

On top surface 22 of each complementary side member 25 of an enclosing unit is the first of two parts of the preferred embodiment's engaging device—a pair of pawls 28 perpendicular to and extending upward on arm 32 from top surface 22. Each pawl 28 biased outward has a slanted surface 30 and an engaging surface 29.

In FIG. 2 tip 12 is shown as a sphere with only one molded shape for first cavity 17 in complementary side members 25 rather than the multiple molded shape of FIG. 1. This change to a single cavity shape is to simplify the drawing, not to indicate that this shape or that only one shape is normally molded in first cavity 17.

Complementary side members 25 are closed around mast 11 and tip 12 where the following ½ cavities of FIG. 1: first 14, second 15, and third 16, become the following whole cavities of this figure: first cavity 17, second cavity 18 and third cavity 19 which extends to opening 23 in side surface 24 from which connective member 10 attached to an object suitable for display—not shown in drawing—is secured therein around mast 11 and exits therefrom.

In FIG. 2 where complementary side members 25 are closed around mast 11 and tip 12, each pawl 28 is perpendicular to top surface 22, with slanted surface 30 facing away from its opposite number. Note that there is sufficient space between pawls 28 to allow a bending toward each other when cap is pressed on or removed, and each pawl 28 has a length of arm 32 to facilitate this bending. Each pawl 28 is also in the same perpendicular position when cap is held on enclosing unit.

In FIG. 3 the second part of the preferred embodiment's engaging device is shown: a cylindrical cap sized to fit closely over the entire length of an enclosing unit. Centered in top surface 41 are differing inside 37 and outside 36 aperture diameters—37 larger and 36 smaller-sized to allow pawls 28 to pass through, yet not so large as to prevent them from performing their mechanical holding function when cap is fully pressed on. This aspect is more clearly shown in FIG. 5.

Opening 38 in side surface 39 of cap is sized to correspond with opening 23 of enclosing unit such as shown in FIG. 2. Note the cap opening extends to bottom edge 35 in order to allow cap to be fully pressed on enclosing unit with connective member in place around mast 11. Sidewall thickness of cap, except to provide stability, is not a significant dimension.

FIG. 4 shows the preferred embodiment of an assembled antenna clamp around mast 11 with connective member 10 exiting opening 23 of enclosing unit and opening 38 of cap in which cap is pressed on enclosing unit and mechanically held by pawls 28. Pawls 28 are extended first through inside aperture 37 (not shown) and then through outside aperture 36 so that engaging surface 29 extends over top surface 41 of cap providing mechanical means of holding enclosing unit to mast 11 and tip 12 with connective member 10 therein and around said mast 11 and exiting opening 23 in side surface 24 of enclosing unit over which is opening 38 of side surface 39 of cap.

A close fitting cap would keep enclosing unit closed around mast 11 and tip 12 but would not alone keep itself in place. In this embodiment a pair of pawls 28 act in conjunction with a cap as an engaging member to provide mechanical holding means to hold cap on thereby secure enclosing unit around mast 11 and tip 12. This explains the reason for defining the engaging device of our preferred embodiment as cap and pawls.

In the lower portion of FIG. 4 and below cavity 19 is outside surface 24 of enclosing unit. There is no cap surface in this area in order that it can be pressed on or removed from enclosing unit when cord 10 is around mast 11. Complementary side members 25 are shown coming together at parting line 27. Cutting line shows location of FIG. 5.

In FIG. 5 a cross sectional view is shown of a pair of pawls 28 attached to top surface 22 of enclosing unit extending perpendicularly upward through a cap which is pressed fully on. This perpendicular attitude exists in two circumstances: when there is no cap on enclosing unit and when cap is being mechanically held on enclosing unit. To put on or take off cap requires pawls 28 to flex or bend. Pawls 28 need to be separated by a distance sufficient for the sum of this required movement.

Additionally top surface 41 of cap needs to be above top surface 22 of enclosing unit to provide a length to pawl arm 32 so that putting on cap or removing it by a pressing of pawls 28 together can be done easily. In FIG. 5 this distance is assured by thickness of cap top 47.

When cap is pressed on enclosing unit slanted surface 30 of pawls 28 contacts first a larger inside aperture 37 and then a smaller outside aperture 36. The narrowing of aperture causes pawls 28 to bend inward or toward each other until cap is fully pressed on. Then each pawl 28 snaps back to its perpendicular position forcing each engaging surface 29 of pawl 28 over top surface 41 of cap thereby mechanically holding cap on enclosing unit.

Cap removal is accomplished by pressing together pawls 28 forcing engaging surfaces 29 away from top surface 41 of cap and allowing cap to be lifted off enclosing unit.

Summarizing the structural description for the preferred embodiment, we say that a cap holds a pair of complementary side members 25 of enclosing unit together around mast 11 and tip 12, and is itself mechanically held in place by pawls 28 attached to an enclosing unit with connective member 10 therein and around mast 11 and exiting opening 23.

Figure 6:
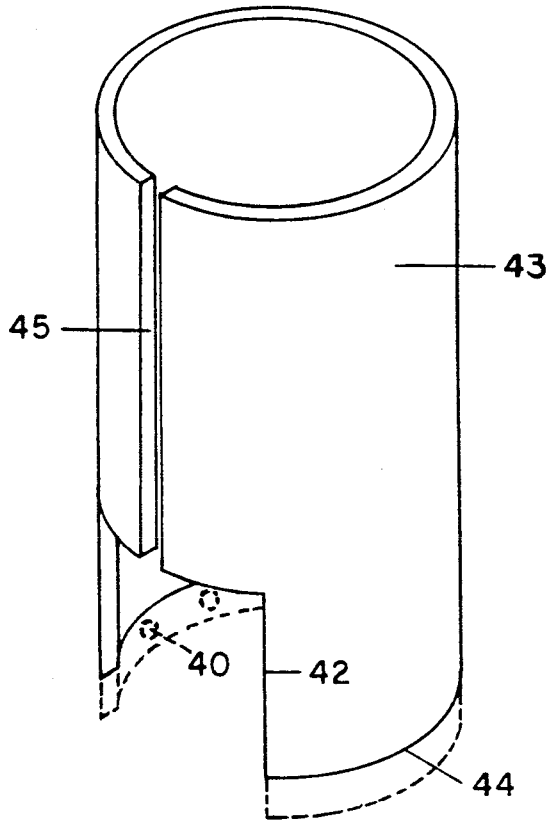
FIG. 6 shows cylindrical split-ring engaging device with split-ring ends, opening and dotted line extension with bubbles.

While the preferred embodiment employs cap and pawls 28 to mechanically hold, the embodiment in FIG. 6 performs this mechanical holding with a different engaging device. In FIG. 6 the engaging device is a cylindrical split-ring spring made from a resilient material. The spring fits around and secures an enclosing unit to mast 11 and tip 12. Split-ring ends 45 are centered above opening 42 in side surface 43. This opening 42 extends to bottom edge 44 to allow the spring to be pressed over enclosing unit with connective member 10 in place around mast 11, and is sized to correspond to opening 23 of enclosing unit of FIG. 2.

A cylindrical split-ring spring has a somewhat smaller diameter in static equilibrium than the diameter of enclosing unit and offers resistance to a force tending to enlarge its diameter when pressed on enclosing unit. As in FIG. 2 but without pawls configuration (not shown) a split-ring spring engaging device holds complementary side members 25 of enclosing unit together by pressing against side surfaces with its cylindrical form and in so doing performs a mechanical holding means to keep enclosing unit closed around mast 11 and tip 12 with connective member 10 therein and around mast 11 and exiting an opening 23 of side surface 24 of enclosing unit over which is opening 42 on side surface 43 of split-ring spring.

The split-ring spring resists unintended removal by force of kinetic friction. Thus the spring holds mechanically, making use of frictional forces to keep itself secure over enclosing unit. The magnitude of these frictional forces comes from such factors as: (1) kind of material used, (2) thickness of material, and (3) static diameter to which the spring is formed.

If additional holding power is needed, the split-ring spring can be lengthened somewhat to fit slightly below bottom surface 20 of enclosing unit when fully pressed on. It can have molded around its inside lower surface a number of small bubbles 40. Bubbles and extension are shown in a dotted line lower portion of FIG. 6. Bubbles add an impediment to first movement thus aiding frictional holding power.

Figure 7:
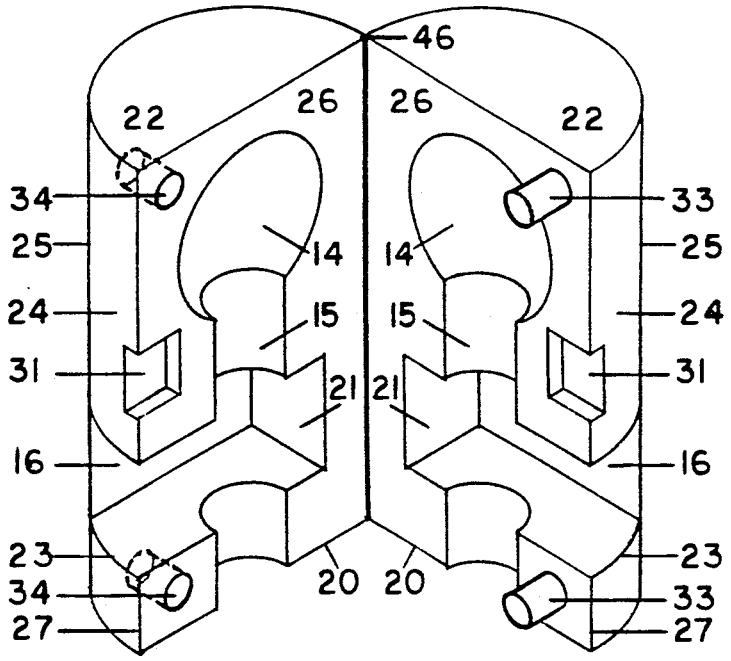
FIG. 7 shows male-female engaging device on abutment surfaces of complementary side members.

In FIG. 7 we show another embodiment. Rather than a separate engaging device here the engaging device is an integral part of an enclosing unit and performs a mechanical holding of enclosing unit to mast 11 and tip 12. This integral engaging device consists of a pair of male cylindrical projections 33 outwardly perpendicular and a pair of female cavities 34, inwardly perpendicular to abutment surfaces 26 of complementary side members 25 with male and female devices being oppositely located on abutment surfaces and sized to fit tightly to provide mechanically holding means to keep complementary side members 25 closed around mast 11 and tip 12 with connective member 10 therein and around mast 11 and exiting an opening 23 in side surface 24 of enclosing unit.

We indicate by drawing but do not insist which abutment surface has male and which has female engaging device.

If only one male-female pair is used then the pair can be centered near an edge opposite hinge 46. If greater holding power is required the diameter of a single male-female unit can be increased within space constraints or two pairs can be used as is shown in FIG. 7. Two pairs can be located on abutment surface 26 near top surface 22 and bottom surface 20 on an edge opposite hinge 46. Regardless of whether one or two pairs is used, an indent 31 can be molded at parting line 27 to facilitate opening the unit by coin or small tool.

Summarizing, in each of the embodiments an engaging device—whether cap and pawls or cylinder split-ring spring or integral male projecting female cavity units, or others that may come within &he attached claims purview--holds an enclosing unit around mast and tip using mechanical means, and in each case thereby a connective member is secured by the enclosing unit and thus accomplishes the stated purpose of the antenna clamp: to secure a connective member to a mast so it will not come off or slide down but be free to rotate in the wind. In one case frictional forces are utilized to facilitate this purpose.

Operation of Preferred and Alternative Embodiments in FIGS. 1 to 7

To use the preferred embodiment of the antenna clamp first place and hold taut the connective member 10 of the object to be displayed around the top of antenna mast 11. Then, as can be visualized from FIG. 1, simultaneously place mast 11 in second ½ cavity 15 and tip 12 in first ½ cavity 14 with connective member 10 in third ½ cavity 16 of an enclosing unit and press abutment surfaces together. Holding enclosing unit together as in FIG. 2 creates for mast 11 a whole second cavity 18 and for tip 12 a whole first cavity 17. Before putting on a cap make sure that connective member 10 exiting opening 23 is free to rotate in whole third cavity 19.

While still holding enclosing unit with connective member 10 in place, press cap engaging device of FIG. 3 over the top of enclosing unit so that opening 38 coincides with opening 23 of enclosing unit. As the cap is pressed on, pawls 28 of enclosing unit (the other half of the engaging device of the preferred embodiment) flex inward and emerge through aperture 36 then snap back &o original perpendicular position with engaging surface 29 covering top surface 41 of cap to hold mechanically the cap in place as shown in FIG. 4. The antenna clamp is thus held in place around mast 11 and tip 12 but is free to rotate wi&h its banner-like object.

To remove clamp from mast, press together the tops of pawls 28, which can be visualized in FIG. 5. As pawls 28 flex inwardly engaging surfaces 29 of pawls 28 become free of top surface 41 of cap, allowing pawls 28 to be easily pressed down through aperture 36 of cap permitting cap to be lifted off enclosing unit which can then be opened to release connective member 10 for removal or replacement of object held.

To use cylindrical split-ring spring engaging device shown in FIG. 6 place the enclosing unit and connective member 10 of object around mast 11 and tip 12 as described for preferred embodiment and hold in place while pressing spring on enclosing unit until tops are level and opening 42 coincides with opening 23 of enclosing unit. Split-ring spring mechanically holds enclosing unit around mast 11 and tip 12 with connective member 10 exiting opening 42 of spring and opening 23 of enclosing unit. If bubbles 40 are molded on a bottom edge 44 of the spring, press until tops of spring and enclosing unit are level. The spring, itself, is held on the enclosing unit by the force of friction and by bubbles if used.

To remove split-ring spring engaging device exert pulling effort upward to counter its built-in frictional holding force and spring can be lifted off top of enclosing unit and the enclosing unit can be opened for whatever reason.

To use integral engaging device shown in FIG. 7 place enclosing unit with integral male-female members and connective member 10 around antenna mast 11 and tip 12 as described in preferred embodiment with connective member 10 exiting opening 23 then press the hinged complementary halves 25 of enclosing unit together tightly so that male projections 33 and female cavities 34 on abutment surfaces 26 are mechanically holding enclosing unit closed around mast 11 and tip 12.

To remove enclosing unit exert a twisting force at indent 31 on parting line 27 by inserting coin or small tool so that male projections 33 and female cavities 34 are disengaged and the enclosing unit can be opened and freed from mast 11 and tip 12.

Conclusion

The earlier listing of objects and advantages, and the foregoing presentation of structure and operations of the preferred and alternative embodiments in FIGS. 1 to 7 of the antenna clamp, are presented for &he purposes of illustration, description and explanation. These are not intended to be exhaustive or to limit the invention to the precise form disclosed. Many modifications and variations of the clamp are possible in light of the above teaching.

Therefore, it is intended that the scope of the invention be limited not by this detailed description, but rather by the claims appended hereto.

We claim:

1. An antenna clamp for securing a connective member of an object suitable for display around a top of a vehicle antenna mast, said mast having an enlarged tip at its upper end, comprising:

an enclosing unit having a cylindrical shape and comprising a pair of complementary side members hinged together with each said side member having a top surface, a bottom surface, a side surface and an opening in said side surface, said side members fitting rotatably around said mast and said tip with said connective member therein and around said mast and exiting said opening in said side surface, and with each said side member having an abutment surface perpendicular to said top surface and said bottom surface wherein each said abutment surface comprises:

a first ½ cavity having a tip shape on a longitudinal center line;

a second ½ cavity having a cylindrical shape extending longitudinally on said center line from said first ½ cavity to said bottom surface; and a third ½ cavity perpendicular to and laterally traversing said second ½ cavity having one closed end and extending to said side surface; and means to hold mechanically said enclosing unit to said mast and said tip in combination with an engaging device.

2. The antenna clamp of claim 1 wherein said first ½ cavity is of spherical shape.

3. The antenna clamp of claim 1 wherein said first ½ cavity is of cylindrical shape.

4. The antenna clamp of claim 1 wherein said first ½ cavity is of conical shape.

5. The antenna clamp of claim 1 wherein said mechanical holding means comprises said engaging device including:

a cylindrical cap sized to provide a close fit over said enclosing unit and having a top surface containing an aperture and having a side surface containing an opening extending to a bottom edge and sized to correspond to said opening in said side surface of said enclosing unit; and a pair of pawls on said top surface of said enclosing unit being outwardly based and extending upwardly from said top surface of said enclosing unit such that said cap being pressed over said enclosing unit causing said pawls to bend toward each other as said pawls are forced through said aperture and to bend away form each other as said pawls are fully extended through said aperture wherein said pawls extend over said top surface of said cap, such that said pawls mechanically hold said cap in place over said enclosing unit with said cap holding said enclosing unit closed around said mast and said tip with said connective member therein and around said mast and exiting an opening in said side surface.

6. An antenna clamp for securing a connective member of an object suitable for display around a top of a vehicle antenna mast, said mast having an enlarged tip at its upper end, comprising:

an enclosing unit of cylindrical shape having a complementary pair of side members hinged together and fitting rotatably around said mast and said tip with said connective member therein around said mast and exiting an opening in a side surface; and wherein each said side member having an addition to said side surface, a top surface, a bottom surface and an abutment surface perpendicular thereto; and means to hold mechanically and frictionally said enclosing unit to said mast and said tip in combination with an engaging device.

7. The antenna clamp of claim 6 wherein each said abutment surface comprises:

a first ½ cavity having a tip shape on a longitudinal center line;

a second ½ cavity having a cylindrical shape extending longitudinally on said center line from said first ½ cavity to said bottom surface; and a third ½ cavity perpendicular to and laterally traversing said second ½ cavity having one closed end and extending to said side surface;

8. The antenna clamp of claim 7 wherein said first ½ cavity is of spherical shape.

9. The antenna clamp of claim 7 wherein said first ½ cavity is of cylindrical shape.

10. The antenna clamp of claim 7 wherein said first ½ cavity is of conical shape.

11. The antenna clamp of claim 6 wherein said mechanical and frictional holding means comprise said engaging device including:

a cylindrical split ring spring having a side surface containing an opening extending to a bottom edge and located equal distance between open ring ends and sized to correspond to said opening in said side surface of said enclosing unit; and further comprising resilient material to offer resistance to a force tending to enlarge the diameter of said spring such that when pressed over said enclosing unit said side surface of said spring presses against said side surface of said enclosing unit to hold mechanically said enclosing unit closed around said mast and said tip with said connective member therein and around said mast and exiting an opening in said side surface; and wherein said cylindrical split ring spring is held over said enclosing unit by force of kinetic friction.

12. An antenna clamp for securing a connective member of an object suitable for display around a top of a vehicle antenna mast, said mast having an enlarged tip at its upper end, comprising:

an enclosing unit of cylindrical shape having a complementary pair of side members hinged together and fitting rotatably around said mast and said tip with said connective member therein around said mast and exiting an opening in a side surface; and wherein each said side member having in addition to said side surface, a top surface, a bottom surface and an abutment surface perpendicular thereto; and means to hold mechanically said enclosing unit to said mast and said tip in combination with an integral engaging device.

13. The antenna clamp of claim 12 wherein each said abutment surface comprises:

a first ½ cavity having a tip shape on a longitudinal center line;

a second ½ cavity having a cylindrical shape extending longitudinally on said center line from said first ½ cavity to said bottom surface; and a third ½ cavity perpendicular to and laterally traversing said second ½ cavity having one closed end and extending to said side surface;

14. The antenna clamp of claim 13 wherein said first ½ cavity is of spherical shape.

15. The antenna clamp of claim 13 wherein said first ½ cavity is of cylindrical shape.

16. The antenna clamp of claim 13 wherein said first ½ cavity is of conical shape.

17. The antenna clamp of claim 12 wherein said mechanical holding means comprises said integral engaging device including:

a cylindrical male projection extending outwardly perpendicular from said abutment surface of one said complementary side member and a cylindrical female cavity inwardly perpendicular from said abutment surface of other said complementary side member, and having said male projection and said female cavity located opposite each other, and sized to fit tightly, such that when said complementary side members are pressed together said enclosing unit is mechanically held closed by said integral engaging device around said mast and said tip with said connective member therein and around said mast and exiting an opening in said side surface.

18. An antenna clamp for securing a connective member of an object suitable for display around a top of a vehicle antenna mast, said mast having an enlarged tip at its upper end, comprising:

an enclosing unit of cylindrical shape having a complementary pair of side members, each said side member having a side surface, a top surface, a bottom surface and an abutment surface perpendicular thereto wherein said pair of side members are hinged together and fit rotatably around said mast and said tip, and wherein each said abutment surface comprises:

a first ½ cavity having a tip shape on a longitudinal center line;

a second ½ cavity having a cylindrical shape extending longitudinally on said center line from said first ½ cavity to said bottom surface; and a third ½ cavity perpendicular to and laterally traversing said second ½ cavity having one closed end and extending to said side surface, and means to hold mechanically said enclosing unit to said mast and said tip in combination with said engaging device, comprising:

a cylindrical cap sized to provide a close fit over said enclosing unit and having a top surface containing an aperture, and having a side surface containing an opening extending to a bottom edge and sized to correspond to said opening in said side surface of said enclosing unit; and a pair of pawls on said to surface of said enclosing unit being outwardly biased and extending upwardly from said top surface of said enclosing unit such that said cap being pressed over said enclosing unit causing said pawls to bend toward each other as said pawls are forced through said aperture, and to bend away from each other as said pawls are fully extended through said aperture wherein said pawls extend over said top surface of said cap mechanically holding said cap, such that said pawls mechanically hold said cap in place over said enclosing unit with said cap holding said enclosing unit closed around said mast and tip with said connective member therein and around said mast and exiting said opening in said side surface.

* * * * *

UNITED STATES PATENT AND TRADEMARK OFFICE

CERTIFICATE OF CORRECTION

PATENT NO. : 5,078,075

DATED : January 7, 1992

INVENTOR(S) : Richard E. Liming, et. al.

It is certified that error appears in the above-identified patent and that said Letters Patent is hereby corrected as shown below:

Col. 2, line 15, insert 'spring' after split-ring.

Col. 4, line 54, change 'er-sized' to ---er--sized---.

Col. 8, line 63, change 'based' to ---biased---.

Col. 8, line 68, change 'form' to ---from---.

Col. 9, line 18, change 'an' to ---in---.

Col. 11, line 1, change 'to' to ---top---.

Signed and Sealed this

Twenty-third Day of March, 1993

*Attest:*

STEPHEN G. KUNIN

*Attesting Officer*

*Acting Commissioner of Patents and Trademarks*